US005097559A

United States Patent [19]

Brunt et al.

[11] Patent Number: 5,097,559

[45] Date of Patent: Mar. 24, 1992

[54] CLEANING APPARATUS FOR A LIQUID CONTAINING VESSEL

[75] Inventors: Harold J. Brunt; Eric T. Stenner; Roy V. Bladen, all of Auckland, New Zealand

[73] Assignee: Turlock Products Limited, Auckland, New Zealand

[21] Appl. No.: 602,799

[22] Filed: Oct. 24, 1990

[30] Foreign Application Priority Data

Oct. 30, 1989 [NZ] New Zealand ..... 231196

[51] Int. Cl.[5] ..... E04H 3/20

[52] U.S. Cl. ..... 15/1.7

[58] Field of Search ..... 15/1.7, 319, 340.1, 15/340.2, 340.3

[56] References Cited

U.S. PATENT DOCUMENTS 4,306,329 12/1981 Yokoi ..... 15/319

4,920,599 5/1990 Rief ..... 15/1.7

*Primary Examiner*—Edward L. Roberts

*Attorney, Agent, or Firm*—Fleit, Jacobson, Cohn, Price, Holman & Stern

[57] ABSTRACT

A pool cleaning apparatus is provided with spaced apart drive wheels for mobility and suction apparatus to clean the interior surface of the pool. A supplementary drive roller is provided generally between the drive wheels to move the cleaning apparatus off any convex irregularities that may otherwise strand the apparatus in one position in the pool.

11 Claims, 3 Drawing Sheets

CLEANING APPARATUS FOR A LIQUID CONTAINING VESSEL

FIELD OF THE INVENTION

This invention relates to cleaning apparatus for a liquid containing vessel and has been-devised particularly for incorporation in swimming pool cleaning apparatus having a suction orifice which, in use, is positioned closely adjacent a surface part of the vessel over which the apparatus is travelling.

Background of the Invention

Conventional roving pool cleaning apparatus include a suction device for cleaning the pool and spaced apart drive wheels to provide mobility. A particularly relevant example of this apparatus is described in U.S. Pat. No. 4,722,110.

Cleaning apparatus of this general type may encounter difficulties in negotiating convex irregularities in the pool surface which intrude, at least in part, between the drive wheels. Such irregularities in the pool surface may leave the pool cleaner stranded in one position in the pool.

It is an object of the invention to provide a cleaning apparatus which will overcome this shortcoming of the prior art as outlined above or which will at least provide the public with a useful choice.

Brief Summary of the Invention

Accordingly, the invention consists in cleaning apparatus for cleaning the interior surface of a liquid containing vessel said apparatus including a pair of spaced drive wheels; a suction aperture positioned generally between said drive wheels such that, when said apparatus is in its normal operating position, said suction aperture is located adjacent a part of said interior surface; and supplementary drive means located generally between said drive wheels, said supplementary drive means being operable to effect displacement of said apparatus in the event of said apparatus encountering a convex irregularity on or in said interior surface which intrudes at least in part between said drive wheels.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of the invention will now be described with reference to the accompanying drawings.

DESCRIPTION OF PREFERRED EMBODIMENT

Figure 1:
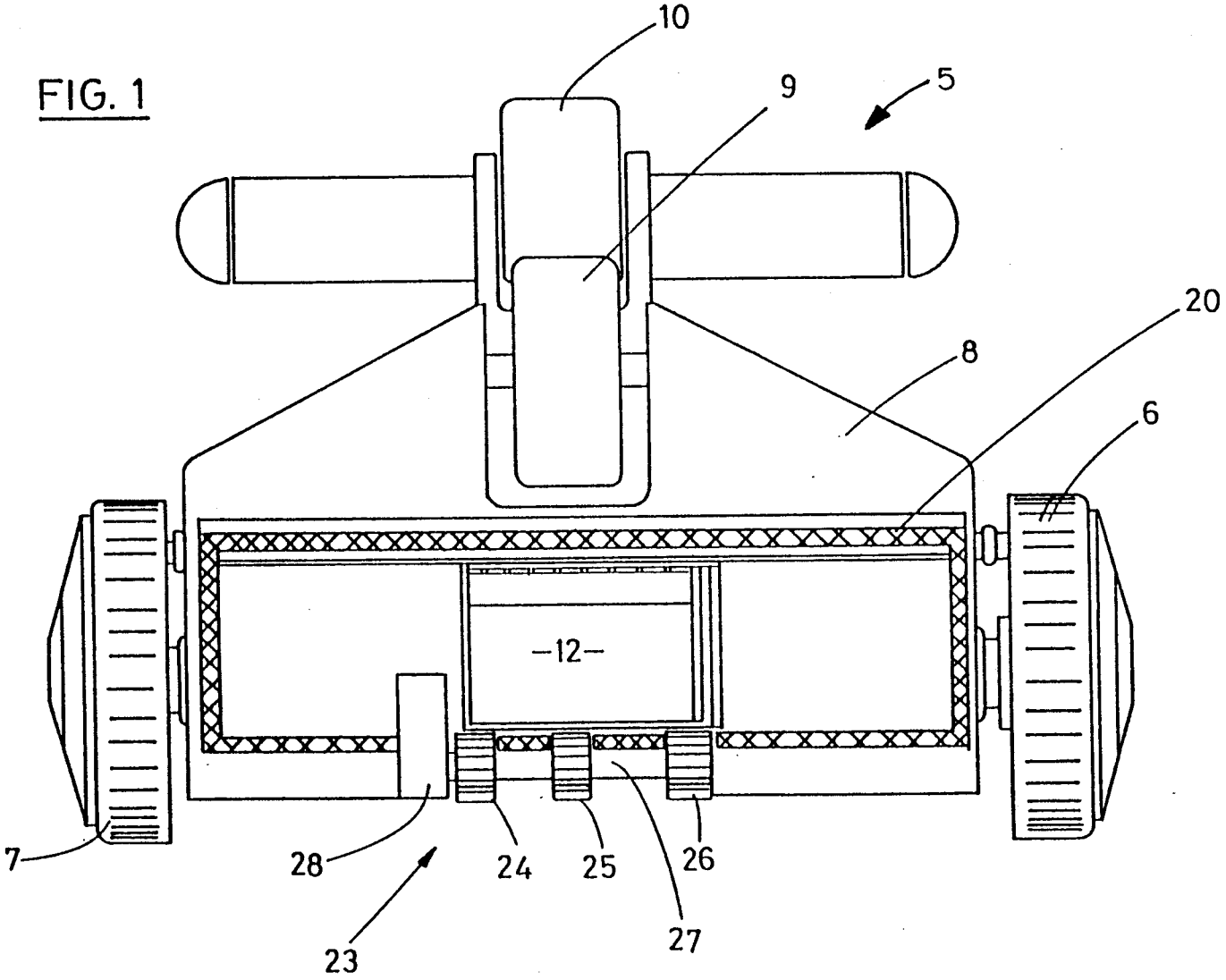
FIG. 1 shows an underneath view of cleaning apparatus according to the invention.
Figure 2:
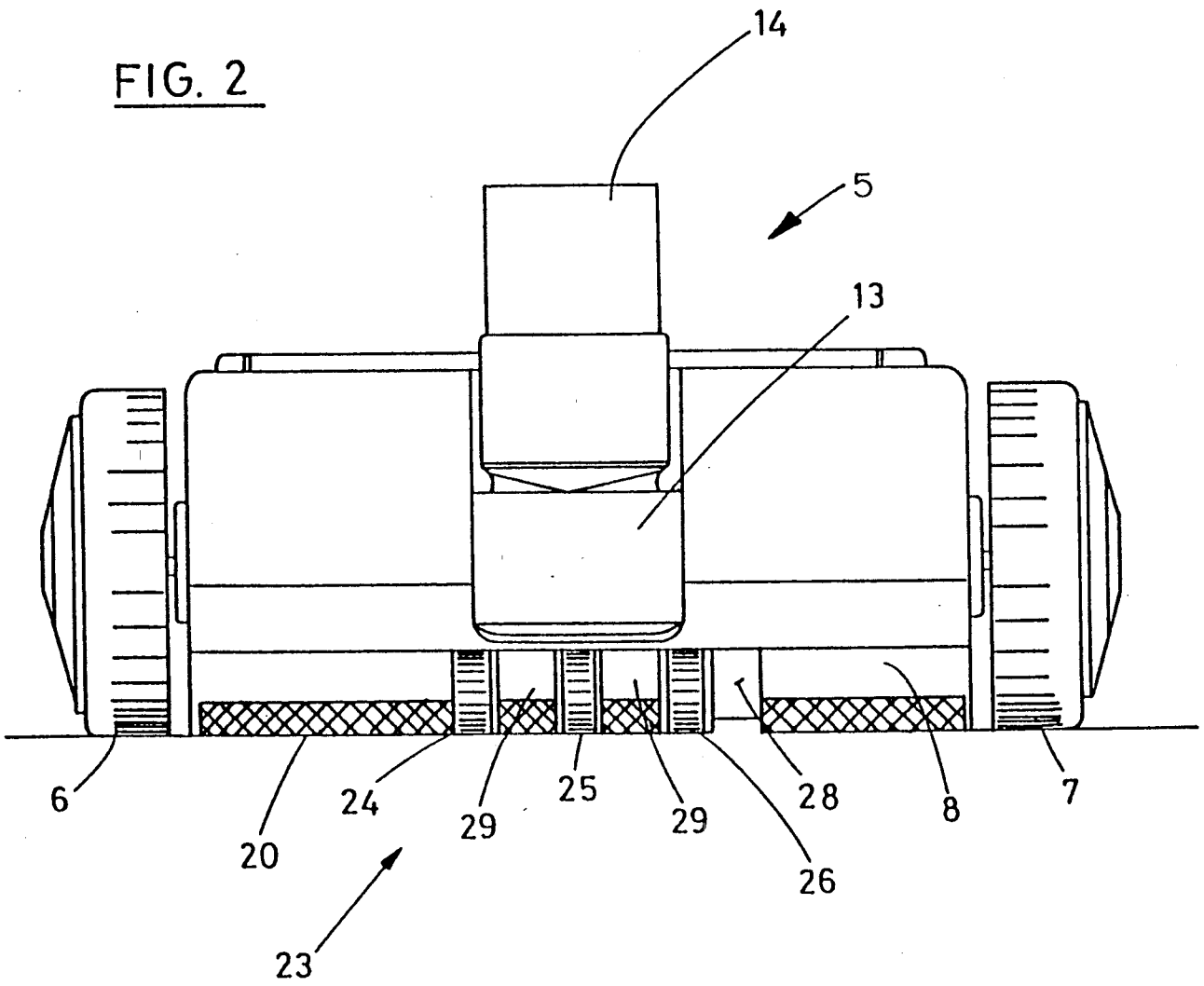
FIG. 2 shows a rear elevational view of the apparatus shown in FIG. 1.
Figure 3:
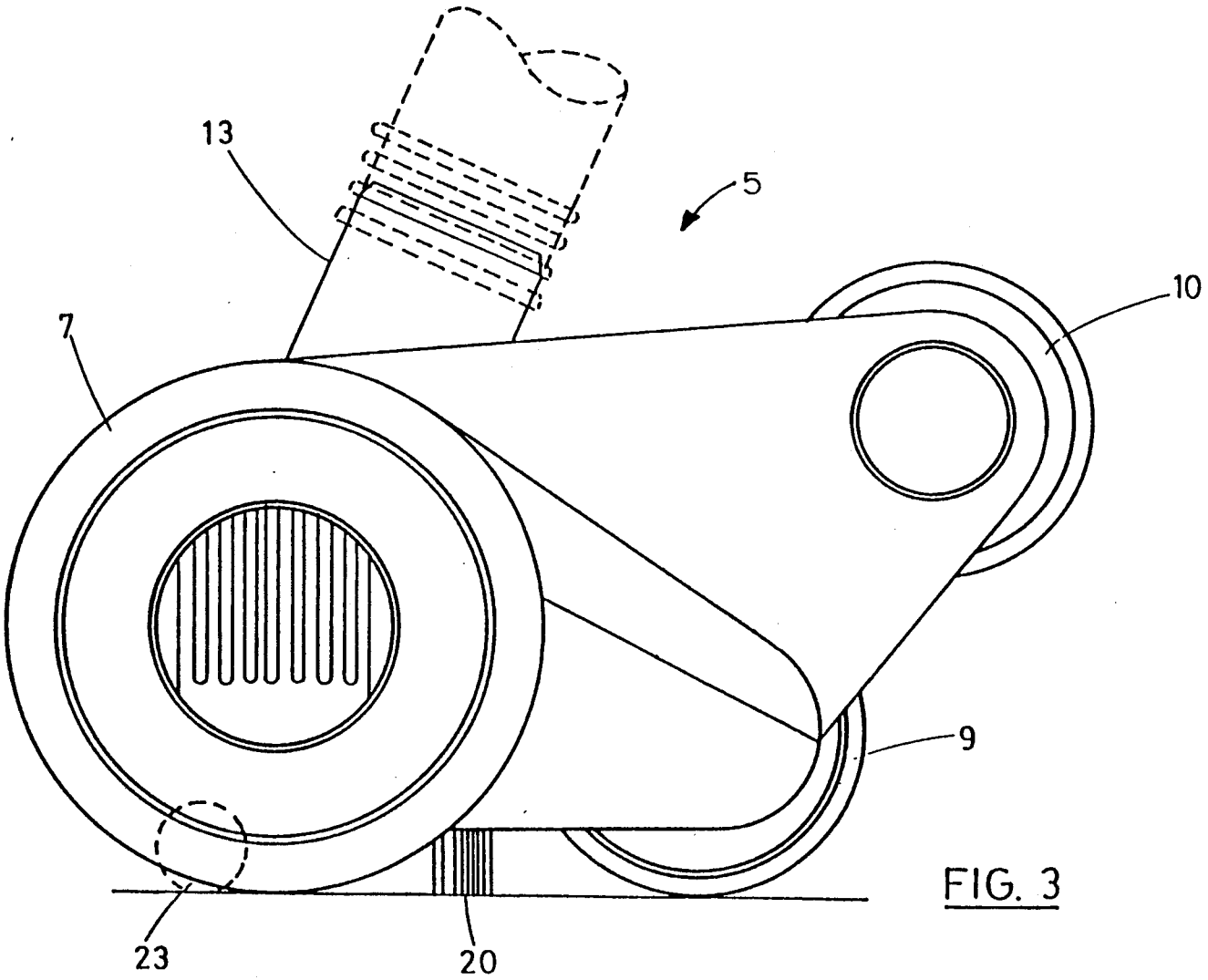
FIG. 3 shows a side elevational view of the apparatus shown in FIGS. 1 and 2.

According to the invention cleaning apparatus 5 is provided for cleaning the interior surface of a liquid containing vessel (not shown). The particular form of apparatus described herein has been developed to clean the wetted surfaces of swimming pools. The invention has been devised particularly for incorporation in the form of cleaning apparatus described and claimed in New Zealand Patent Specification No. 212590 (which is hereby incorporated by way of reference) and the following description will be directed to this form of apparatus although it will be apparent to those skilled in the art that similar forms of supplementary drive could be incorporated in cleaning apparatus of this general type supported on and propelled by spaced drive wheels.

As described in Patent 212590 the cleaning apparatus 5 is provided with spaced drive wheels 6 and 7 mounted on opposite sides of chassis 8. A third, or nose, wheel 9 supports the chassis 8 in combination with the drive wheels 6 and 7 while a guide wheel 10 guides and elevates the front end of the chassis when the cleaner engages an upwardly slanting wall.

A suction aperture 12 is provided on the underside of the chassis 8. The suction aperture 12 is preferably rectangular in form and communicates with the interior of a swivel coupling 13 which includes a hose fitting 14 to which a vacuum hose (not shown) is, in use, attached.

As described in Patent 212590 the vacuum applied to the swivel coupling 13 draws screened water through a turbine (not shown) incorporated in the apparatus which is operable to apply drive to the drive wheels 6 and 7.

Brush seals 20 are also provided on the underside of the chassis 8 and surrounding the suction aperture 12 so that the suction is maintained to retain the cleaning apparatus in engagement with the surface over which it is passing.

In accordance with this invention supplementary drive means are provided so that if the cleaning apparatus comes into contact with a convex irregularity projecting from or included in the surface over which the apparatus is passing such that one of the drive wheels is displaced out of contact with the surface, the supplementary drive means operate to displace the apparatus off the convex irregularity until such time as both drive wheels 6 and 7 again engage the surface.

In the form shown the supplementary drive means comprises a powered roller 23 which is mounted generally between the drive wheels 6 and 7. As can be seen the roller 23 is mounted adjacent one border of the suction aperture 12 and, more preferably, adjacent the rear edge of the suction aperture 12. Further, it will be noted that the roller spans the central longitudinal axis of the cleaner.

The roller 23 is preferably divided into a plurality of drive surfaces, in this case three surfaces 24, 25 and 26. The three surfaces are mounted on a common hub 27 which is engaged, at one end, with a gear box unit 28. The gear box unit 28 serves to transfer drive from the main drive shaft (not shown) included within the apparatus, to the hub 27.

The construction and arrangement is preferably such that the tangential speed of the drive surfaces 24, 25 and 26 differ from the tangential speed of the drive wheels 6 and 7 when rotating together. The purpose of this is to ensure that the random movement of the apparatus is enhanced and also to provide some turning effect when the powered roller 23 and one of the wheels 6 or 7 is in contact with the surface of the pool.

The arrangement is preferably such that the tangential speed of the powered roller 23 is one-half the tangential speed of the drive wheels 6 and 7.

In order to maintain vacuum around the suction aperture 12 supplementary skirts 29 are preferably mounted over the exposed parts of hub 27 to span between the roller drive surfaces 24, 25 and 25, 26.

We have found that the addition of the supplementary drive means as herein described is extremely effective in displacing the apparatus off or over irregularities in swimming pool surfaces such as drainage valves and also junctions between surface parts of the pool arranged at different angles.

In use when a pool cleaner of the type described in Patent 212590, but modified according to the disclosure herein, engages a convex irregularity such that one of the drive wheels 6 or 7, or both drive wheels, are displaced from the pool surface the supplementary drive means engage or grounds on the irregularity and thus displaces the apparatus until the drive wheels 6 and 7 again engage the pool surface.

What is claimed is:

1. Cleaning apparatus for cleaning the interior surface of a liquid containing vessel said apparatus including a pair of spaced drive wheels; a suction aperture positioned generally between said drive wheels such that, when said apparatus is in its normal operative position, said suction aperture is located adjacent a part of said interior surface; and supplementary drive means located generally between said drive wheels, said supplementary drive means being operable to effect displacement of said apparatus in the event of said apparatus encountering a convex irregularity on or in said interior surface which intrudes at least in part between said drive wheels.

2. Cleaning apparatus as claimed in claim 1 wherein said supplementary drive means is mounted along or adjacent a transverse edge of said suction aperture.

3. Cleaning apparatus as claimed in claim 2 wherein said supplementary drive means is mounted adjacent the rear edge of said suction aperture.

4. Cleaning apparatus as claimed in claim 1 wherein said supplementary drive means comprises a powered roller.

5. Cleaning apparatus as claimed in claim 4 wherein said roller is powered from the same source as said drive wheels.

6. Cleaning apparatus as claimed in claim 4 wherein the construction and arrangement is such that the tangential speed of said drive wheels differs from the tangential speed of said roller.

7. Cleaning apparatus as claimed in claim 6 wherein the tangential speed of said powered roller is substantially one-h the tangential speed of said drive wheels.

8. Cleaning apparatus as claimed in claim 4 wherein said powered roller spans the central longitudinal axis of said apparatus.

9. Cleaning apparatus as claimed in claim 4 wherein said powered roller includes a plurality of drive surfaces.

10. Cleaning apparatus as claimed in claim 1 wherein the spaced drive wheels act about a common first axis.

11. Cleaning apparatus as claimed in claim 10 wherein the supplementary drive means act about a second axis, said second axis positioned substantially parallel to said first axis.

* * * * *